US010595620B1

(12) United States Patent
Rosado et al.

(10) Patent No.: US 10,595,620 B1
(45) Date of Patent: Mar. 24, 2020

(54) POWER HEAD AMMUNITION HOLDER SYSTEM

(71) Applicants: Manuel T. Rosado, Jacksonville, FL (US); Michael Podstawa, Jacksonville, FL (US)

(72) Inventors: Manuel T. Rosado, Jacksonville, FL (US); Michael Podstawa, Jacksonville, FL (US)

( * ) Notice: Subject to any disclaimer, the term of this patent is extended or adjusted under 35 U.S.C. 154(b) by 0 days.

(21) Appl. No.: 16/253,297

(22) Filed: Jan. 22, 2019

(51) Int. Cl.
*A45F 5/02* (2006.01)
*F42B 39/02* (2006.01)
*A45F 5/00* (2006.01)

(52) U.S. Cl.
CPC ..... *A45F 5/02* (2013.01); *F42B 39/02* (2013.01); *A45F 2005/006* (2013.01); *A45F 2005/025* (2013.01); *A45F 2200/0591* (2013.01)

(58) Field of Classification Search
CPC ..... A45C 1/04; A45F 2005/006; A45F 5/00; A45F 2005/1073; A45F 5/1026; F41C 33/02; F42B 39/26; A01M 31/006
See application file for complete search history.

(56) References Cited

U.S. PATENT DOCUMENTS

| | | | | | |
|---|---|---|---|---|---|
| 3,186,611 | A * | 6/1965 | Sonderman | D04D 7/00 | 224/605 |
| 4,390,116 | A * | 6/1983 | Fehr | A45F 5/00 | 224/258 |
| D278,456 | S * | 4/1985 | Lewis | 224/103 | |
| D300,346 | S * | 3/1989 | Dale | D22/134 | |
| 5,806,732 | A * | 9/1998 | Hensley | A45F 5/00 | 224/250 |
| D414,602 | S * | 10/1999 | Bolen | D3/215 | |
| 6,923,356 | B2 * | 8/2005 | Reynolds | A45F 3/14 | 224/254 |
| 9,277,744 | B1 * | 3/2016 | Sanders | A01M 31/006 | |
| 2005/0017043 | A1 * | 1/2005 | Link | F42B 39/02 | 224/674 |
| 2016/0095420 | A1 * | 4/2016 | Moreau | A45F 5/021 | 248/341 |

* cited by examiner

*Primary Examiner* — Brian D Nash

(57) ABSTRACT

An ammunition holder has support tubes. Each support tube has a bend at the midpoint. Each support tube has a first intermediate point located between the first end and the midpoint and a second intermediate point located between the second end and the midpoint. A ring has a central opening receiving and retaining the midpoint of each support tube. A wrap positioned around the plurality of support tubes at the midpoints holds together the plurality of support tubes with the first end and the second end of each support tube free to slidably receive and support and dispense ammunition.

6 Claims, 2 Drawing Sheets

POWER HEAD AMMUNITION HOLDER SYSTEM

BACKGROUND OF THE INVENTION

Field of the Invention

The present invention relates to a xtitle and more particularly pertains to receiving and removably supporting bullets for use under water by a sports person. The receiving and removable supporting being done in a safe, convenient, and economical manner.

Description of the Prior Art

The use of power head ammunition holder systems of known designs and configurations is known in the prior art. More specifically, power head ammunition holder systems of known designs and configurations of known designs and configurations previously devised and utilized for the purpose of receiving and removably supporting bullets for use under water by a sports person are known to consist basically of familiar, expected, and obvious structural configurations, notwithstanding the myriad of designs encompassed by the crowded prior art which has been developed for the fulfillment of countless objectives and requirements.

While these devices fulfill their respective, particular objectives and requirements, they do not describe a power head ammunition holder system that allows receiving and removably supporting bullets for use under water by a sports person. The receiving and removable supporting being done in a safe, convenient, and economical manner.

In this respect, the power head ammunition holder system according to the present invention substantially departs from the conventional concepts and designs of the prior art, and in doing so provides an apparatus primarily developed for receiving and removably supporting bullets for use under water by a sports person. The receiving and removable supporting being done in a safe, convenient, and economical manner.

Therefore, it can be appreciated that there exists a continuing need for a new and improved power head ammunition holder system which can be used for receiving and removably supporting bullets for use under water by a sports person. The receiving and removable supporting being done in a safe, convenient, and economical manner. In this regard, the present invention substantially fulfills this need.

SUMMARY OF THE INVENTION

In view of the foregoing disadvantages inherent in the known types of power head ammunition holder systems of known designs and configurations now present in the prior art, the present invention provides an improved power head ammunition holder system. As such, the general purpose of the present invention, which will be described subsequently in greater detail, is to provide a new and improved power head ammunition holder system and method which has all the advantages of the prior art and none of the disadvantages.

To attain this, the present invention essentially comprises a plurality of support tubes. Each support tube has a first end, a second end, and a midpoint spaced from the first end and the second end. Each support tube has a bend at the midpoint. Each support tube has a first intermediate point located between the first end and the midpoint. Each support tube has a second intermediate point located between the second end and the midpoint. A ring has a central opening receiving and retaining the midpoint of each support tube. A wrap is positioned around the plurality of support tubes at the midpoints to hold together the plurality of support tubes with the first end and the second end of each support tube being free to slidably receive and support and dispense ammunition.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved power head ammunition holder system which has all of the advantages of the prior art power head ammunition holder systems of known designs and configurations of known designs and configurations and none of the disadvantages.

It is another object of the present invention to provide a new and improved power head ammunition holder system which may be easily and efficiently manufactured and marketed.

It is further object of the present invention to provide a new and improved power head ammunition holder system which is of durable and reliable constructions.

An even further object of the present invention is to provide a new and improved power head ammunition holder system which is susceptible of a low cost of manufacture with regard to both materials and labor, and which accordingly is then susceptible of low prices of sale to the consuming public, thereby making such power head ammunition holder system economically available to the buying public.

Lastly, it is another object of the present invention is to provide a power head ammunition holder system which can be used for receiving and removably supporting bullets for use under water by a sports person. The receiving and removable supporting being done in a safe, convenient, and economical manner.

These together with other objects of the invention, along with the various features of novelty which characterize the invention, are pointed out with particularity in the claims annexed to and forming a part of this disclosure.

For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1:
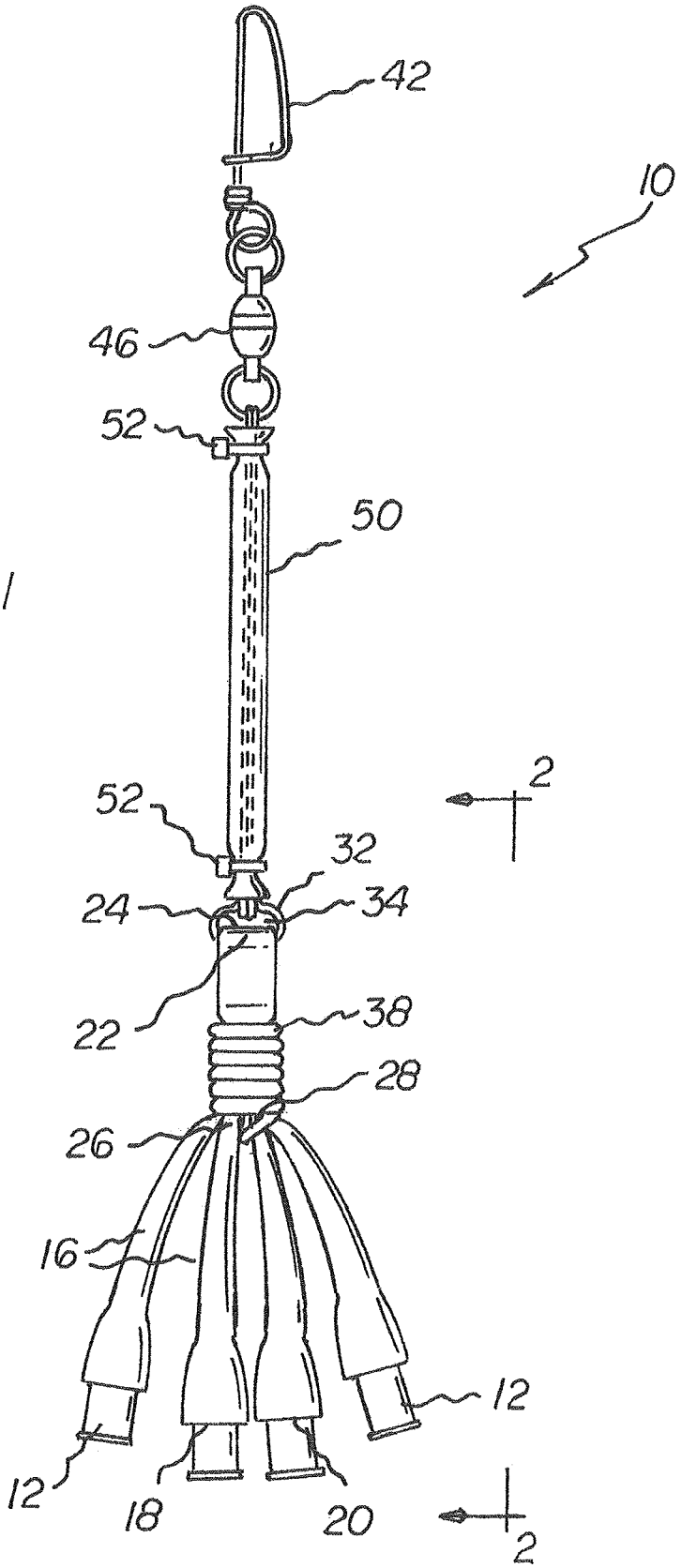
FIG. 1 is a front elevational view of a power head ammunition holder system constructed in accordance with the principles of the present invention.
Figure 2:
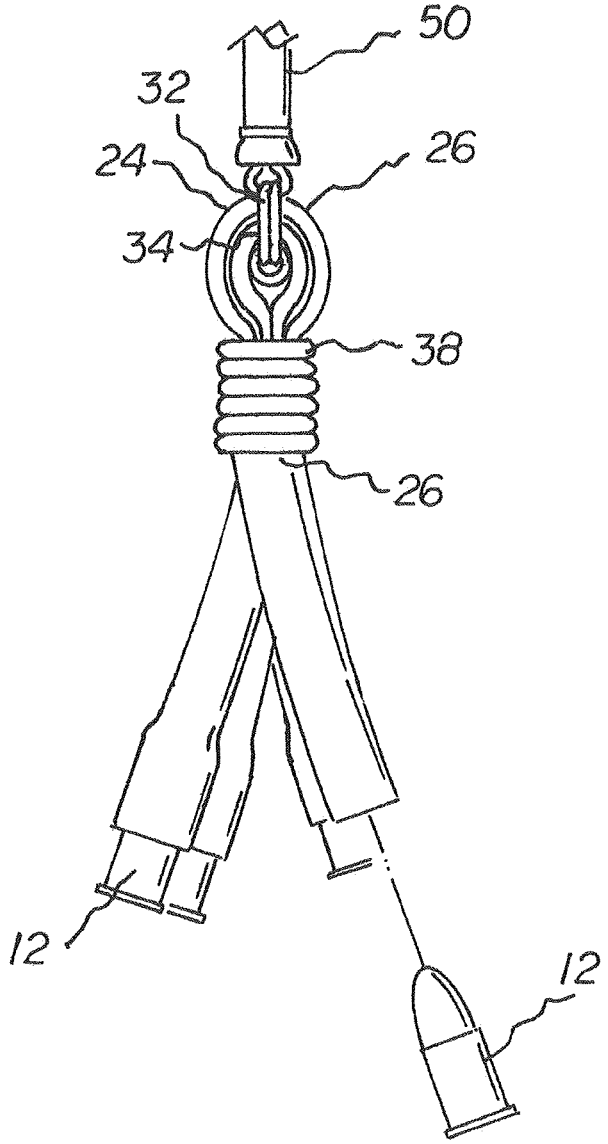
FIG. 2 is an enlarged exploded side elevational view of the lower portion of the power head ammunition holder system shown in FIG. 1.

With reference now to the drawings, and in particular to FIG. 1 thereof, the preferred embodiment of the new and improved power head ammunition holder system embodying the principles and concepts of the present invention and generally designated by the reference numeral 10 will be described.

The present invention, the power head ammunition holder system 10 is comprised of a plurality of components. Such components in their broadest context include a plurality of support tubes, a ring, and a wrap. Such components are individually configured and correlated with respect to each other so as to attain the desired objective.

The preferred embodiment of the invention is a power head ammunition holder system 10 for receiving and removably supporting bullets 12 for use underwater by a sports person. The receiving and removably supporting being done in a safe, convenient and economical manner. First provided are a plurality of support tubes 16. The plurality of support tubes being from 2 to 4 in number. Each support tube has a first end 18, a second end 20, and a midpoint 22 equally spaced from the first end and the second end. Each support tube has a 180 degree bend 24 at the midpoint. Each support tube has a first intermediate point 26 located between the first end and the midpoint. The first intermediate point is located closer to the midpoint than to the first end. Each support tube has a second intermediate point 28 located between the second end and the midpoint. The second intermediate point is located closer to the midpoint than to the second end. Each support tube is fabricated of surgical tubing, an elastomer chosen from the class of elastomers including plastic and rubber, natural and synthetic, and blends thereof. Each support tube has a length of from 7 inches to 11 inches and an interior diameter of from 0.250 inches to 0.375 inches.

Next provided is a ring 32. The ring has a circular central opening 34. The circular central opening receives and retains the midpoint of each support tube.

A spiral nylon rope wrap 38 is coated with nail polish is next provided. The wrap is positioned around the plurality of support tubes at the midpoints to hold together the plurality of support tubes with the first end and the second end of each support tube being free to slidably receive and support and dispense ammunition.

Next, a clip 42 is provided. The clip is coupled to the ring. The clip functions to removably couple the ring and the support tubes to apparel of the sports person utilizing the system.

A snap barrel swivel 46 is next provided. The swivel rotatably couples the clip and the ring to facilitate rotation of the ring and the support tubes with respect to the clip and the sports person.

Lastly, an extension tube 50 is provided. The extension tube is between the connector and the ring with zip ties 52 to allow positioning the support tubes and the ammunition spaced from the sports person to thereby facilitate slidably receiving and supporting and dispensing ammunition.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A power head ammunition holder system comprising:

a plurality of support tubes, each support tube having an interior diameter of from 0.250 inches to 0.375 inches, each support tube having a first end and a second end and a midpoint spaced from the first end and the second end, each support tube having a bend at the midpoint, each support tube having a first intermediate point located between the first end and the midpoint, each support tube having a second intermediate point located between the second end and the midpoint;

a ring having a central opening, the central opening receiving and retaining the midpoint of each support tube; and a wrap positioned around the plurality of support tubes at the midpoints to hold together the plurality of support tubes with the first end and the second end of each support tube being free to slidably receive and support and dispense ammunition.

2. The system as set forth in claim 1 wherein each support tube is fabricated of an elastomer chosen from the class of elastomers including plastic and rubber, natural and synthetic, and blends thereof.

3. The system as set forth in claim 1 wherein each support tube has a length of from 7 inches to 11 inches.

4. The system as set forth in claim 1 wherein the plurality of support tubes are from 2 to 4 in number.

5. A power head ammunition holder system comprising:

a plurality of support tubes, each support tube having a first end and a second end and a midpoint spaced from the first end and the second end, each support tube having a bend at the midpoint, each support tube having a first intermediate point located between the first end and the midpoint, each support tube having a second intermediate point located between the second end and the midpoint;

a ring having a central opening, the central opening receiving and retaining the midpoint of each support tube; and a wrap positioned around the plurality of support tubes at the midpoints to hold together the plurality of support tubes with the first end and the second end of each support tube being free to slidably receive and support and dispense ammunition;

a clip coupled to the ring to removably couple the ring and the support tubes to apparel of the sports person utilizing the system;

a connector rotatably coupling the clip and the ring to facilitate rotation of the ring and the support tubes with respect to the clip and the sports person; and an extension tube between the connector and the ring to allow positioning the support tubes and the ammunition spaced from the sports person thereby facilitating slidably receiving and supporting and dispensing ammunition.

6. A power head ammunition holder system 10 for receiving and removably supporting bullets (12) for use under water by a sports person, the system comprising, in combination:

a plurality of support tubes (16), the plurality of support tubes being from 2 to 4 in number, each support tube having a first end (18) and a second end (20) and a midpoint (22) equally spaced from the first end and the second end, each support tube having a 180 degree bend (24) at the midpoint, each support tube having a first intermediate point (26) located between the first end and the midpoint, the first intermediate point being located closer to the midpoint than to the first end, each support tube having a second intermediate point (28) located between the second end and the midpoint, the second intermediate point being located closer to the midpoint than to the second end, each support tube being fabricated of surgical tubing, each support tube having a length of from 7 inches to 11 inches and an interior diameter of from 0.250 inches to 0.375 inches;

a ring (32) having a circular central opening (34), the circular central opening receiving and retaining the midpoint of each support tube;

a spiral nylon rope wrap (38) coated with nail polish positioned around the plurality of support tubes at the midpoints to hold together the plurality of support tubes with the first end and the second end of each support tube being free to slidably receive and support and dispense ammunition;

a clip (42) coupled to the ring to removably couple the ring and the support tubes to apparel of the sports person utilizing the system;

a snap barrel swivel (46) rotatably coupling the clip and the ring to facilitate rotation of the ring and the support tubes with respect to the clip and the sports person; and an extension tube (50) between the connector and the ring with zip ties (52) to allow positioning the support tubes and the ammunition spaced from the sports person to thereby facilitate slidably receiving and supporting and dispensing ammunition.

* * * * *